US010551149B2

(12) United States Patent
Teetzel et al.

(10) Patent No.: US 10,551,149 B2
(45) Date of Patent: Feb. 4, 2020

(54) POWERED ACCESSORY PLATFORM FOR WEAPON

(71) Applicant: WILCOX INDUSTRIES CORP., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 15/146,094

(22) Filed: May 4, 2016

(65) Prior Publication Data

US 2016/0327371 A1 Nov. 10, 2016

Related U.S. Application Data

(60) Provisional application No. 62/156,484, filed on May 4, 2015.

(51) Int. Cl.

| | |
|---|---|
| ***F41G 11/00*** | (2006.01) |
| ***F41C 23/16*** | (2006.01) |
| *F41G 1/34* | (2006.01) |

(52) U.S. Cl.

CPC ..... *F41G 11/003* (2013.01); *F41C 23/16* (2013.01); *F41G 1/34* (2013.01)

(58) Field of Classification Search

CPC ..... F41C 23/14; F41C 23/16; F41C 23/22; F41C 27/00; F41G 11/003

USPC ..... 42/71.01, 72, 73, 84, 90, 123–124, 131, 42/146

See application file for complete search history.

(56) References Cited

U.S. PATENT DOCUMENTS

| | | | | |
|---|---|---|---|---|
| 3,854,231 | A | 12/1974 | Broyles | |
| 4,689,911 | A | 9/1987 | White | |
| 5,555,662 | A | 9/1996 | Teetzel | |
| 6,725,594 | B2 * | 4/2004 | Hines | F41A 35/02 42/124 |

(Continued)

FOREIGN PATENT DOCUMENTS

WO 20110085464 A1 7/2011

OTHER PUBLICATIONS

International Search Report received in PCT/US2016/030667 dated Jul. 29, 2016.

*Primary Examiner* — Stephen Johnson
*Assistant Examiner* — Benjamin S Gomberg
(74) *Attorney, Agent, or Firm* — McLane Middleton, Professional Association

(57) ABSTRACT

A powered accessory platform for a weapon includes a handguard assembly having an upper handguard portion and an opposed lower handguard portion. The upper handguard portion and the lower handguard portion cooperate to define a sleeve. The sleeve has a proximal end configured to attach to the weapon and a distal end opposite the proximal end. The sleeve is configured to surround at least a portion of the weapon when the proximal end is attached to the weapon. A flexible circuit within the sleeve includes one or more circuit elements disposed on a flexible circuit substrate. An accessory mounting rail is located on a top portion of the upper handguard portion, the mounting rail having at least one electrical connector thereon. A first accessory mounting pad is mechanically and electrically coupled to the accessory mounting rail. A power supply connector on the sleeve is configured to attach a power supply.

27 Claims, 18 Drawing Sheets

(56) References Cited

U.S. PATENT DOCUMENTS 7,021,187 B1 4/2006 Grassi
7,627,975 B1 * 12/2009 Hines ..... F41C 23/16 42/84
7,975,419 B2 * 7/2011 Darian ..... F41G 11/003 42/84
8,091,265 B1 1/2012 Teetzel et al.
8,397,418 B2 * 3/2013 Cabahug ..... F41C 23/22 42/71.01
8,490,313 B2 * 7/2013 Frascati ..... F16B 2/185 42/71.01
9,062,933 B1 * 6/2015 Allen ..... F41G 1/35
9,200,867 B1 * 12/2015 Swan ..... F41C 23/16
9,279,639 B2 * 3/2016 Hines ..... F41C 23/22
9,841,249 B1 12/2017 Nicks et al.
2002/0131585 A1 9/2002 Jones et al.
2006/0191183 A1 8/2006 Griffin
2007/0017139 A1 1/2007 Larue
2007/0033851 A1 2/2007 Hochstrate et al.
2008/0134562 A1 6/2008 Teetzel
2009/0044439 A1 2/2009 Phillips et al.
2009/0178325 A1 7/2009 Veilleux
2009/0188976 A1 7/2009 Gunnarsson et al.
2010/0192444 A1 8/2010 Cabahug et al.
2010/0192448 A1 * 8/2010 Darian ..... F41C 23/22 42/84
2011/0010979 A1 * 1/2011 Houde-Walter ..... F41C 23/22 42/84
2011/0136350 A1 6/2011 Palli et al.
2011/0162245 A1 7/2011 Kamal et al.
2011/0173865 A1 * 7/2011 Compton ..... F41G 11/003 42/84
2011/0283585 A1 11/2011 Cabahug et al.
2012/0144716 A1 6/2012 Cabahug et al.
2012/0180363 A1 7/2012 Frascati et al.
2012/0194419 A1 8/2012 Osterhout et al.
2012/0311906 A1 12/2012 Troy et al.
2013/0036646 A1 2/2013 Rubac
2013/0061504 A1 * 3/2013 Malherbe ..... F41G 11/003 42/84
2013/0104438 A1 5/2013 Hines
2013/0104439 A1 * 5/2013 Hines ..... F41C 27/00 42/84
2014/0059911 A1 * 3/2014 Oh ..... F41C 23/22 42/16
2014/0150317 A1 6/2014 Esserman et al.
2014/0190061 A1 7/2014 Griffin
2014/0215881 A1 8/2014 Milde
2014/0360077 A1 12/2014 Miller et al.
2015/0369554 A1 12/2015 Kramer
2016/0010949 A1 1/2016 Teetzel et al.
2016/0054080 A1 2/2016 Haimi
2016/0061560 A1 3/2016 Saadon
2016/0084161 A1 3/2016 Lyren
2016/0153744 A1 6/2016 Teetzel et al.
2016/0195351 A1 7/2016 Burden
2016/0209169 A1 * 7/2016 Toole ..... F41G 1/35
2016/0327371 A1 11/2016 Teetzel et al.
2017/0205202 A1 7/2017 Teetzel et al.
2018/0106568 A1 4/2018 Hedeen et al.
2019/0249958 A1 8/2019 Teetzel et al.

* cited by examiner 422
428
320
A
420

428
422
420
126
120
320
284
122
A
D
350

POWERED ACCESSORY PLATFORM FOR WEAPON

CROSS-REFERENCE TO RELATED APPLICATION

This application claims the priority benefit of U.S. provisional application No. 62/156,484 filed May 4, 2015. The aforementioned provisional application is incorporated herein by reference in its entirety.

BACKGROUND

The present disclosure relates generally to the field of electrical power distribution and, more particularly, to a system and method for providing electrical power to one or more power consuming weapon accessories which are mounted on a powered accessory platform of a weapon.

SUMMARY

A powered accessory platform for a weapon includes a handguard assembly including an upper handguard portion and an opposed lower handguard portion. The upper handguard portion and the lower handguard portion cooperate to define a sleeve, the sleeve having a proximal end configured to attach to the weapon and a distal end opposite the proximal end. The sleeve is configured to surround at least a portion of the weapon when the proximal end is attached to the weapon. A flexible circuit is disposed within the sleeve, the flexible circuit comprising one or more circuit elements disposed on a flexible circuit substrate. An accessory mounting rail is located on a top portion of the upper handguard portion, the mounting rail having at least one electrical connector thereon. An accessory mounting pad is mechanically and electrically coupled to the accessory mounting rail. A power supply connector on the sleeve configured to attach a power supply.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
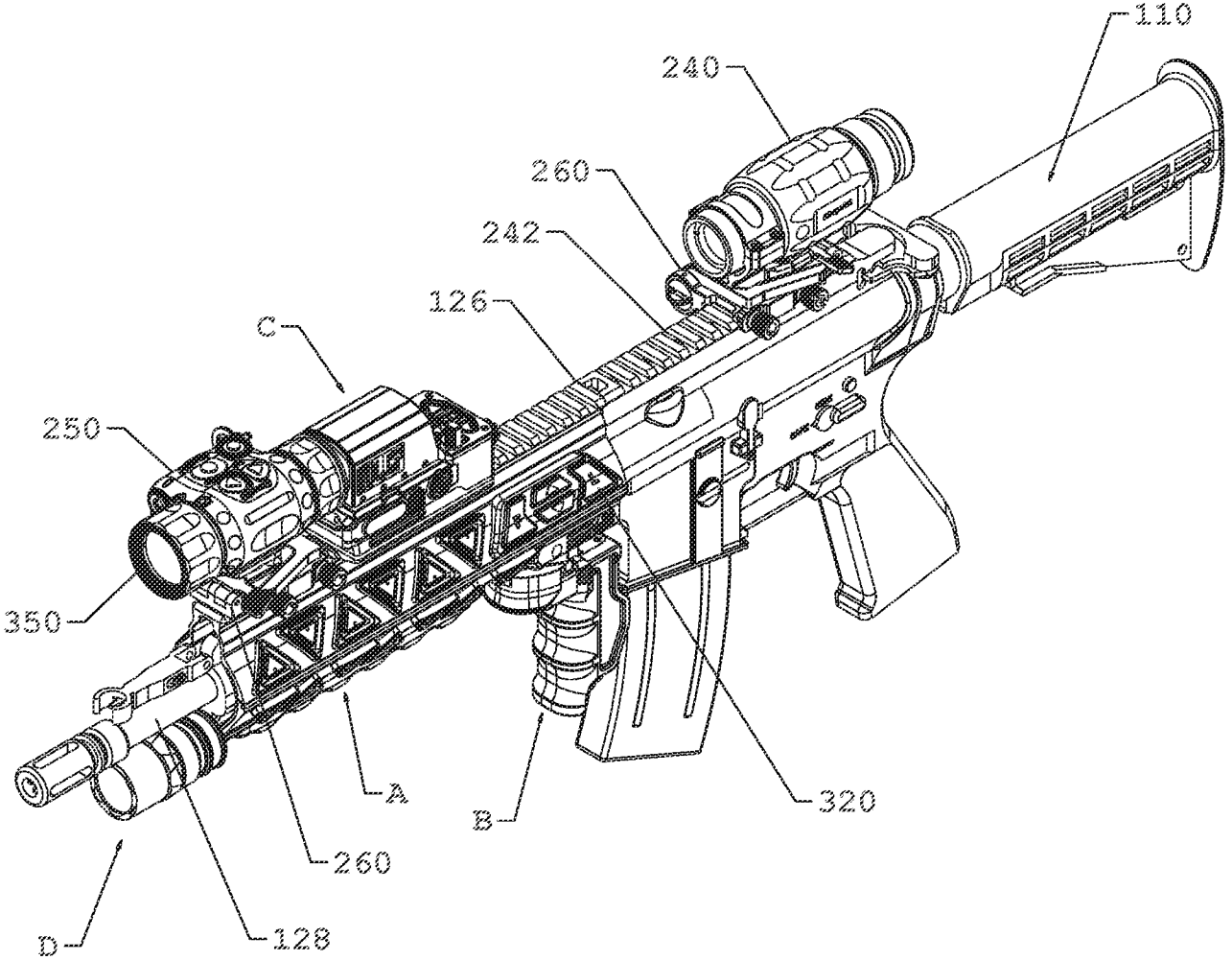
FIG. 1 is an isometric view of a firearm employing a powered weapon accessory system in accordance with an exemplary embodiment of the invention.
Figure 2:
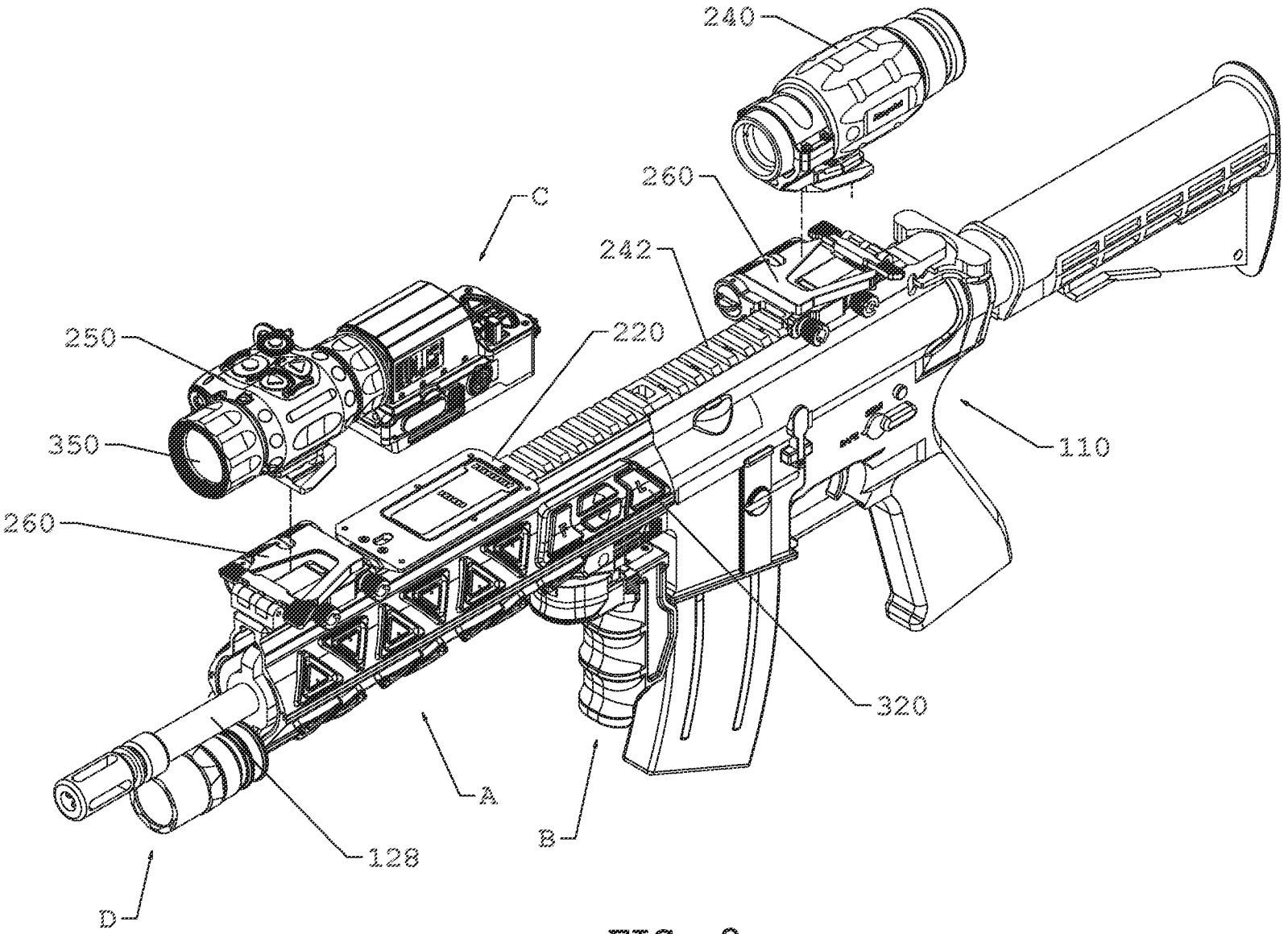
FIG. 2 is a partially exploded view of the firearm and powered weapon accessory platform system appearing in FIG. 1.
Figure 3:
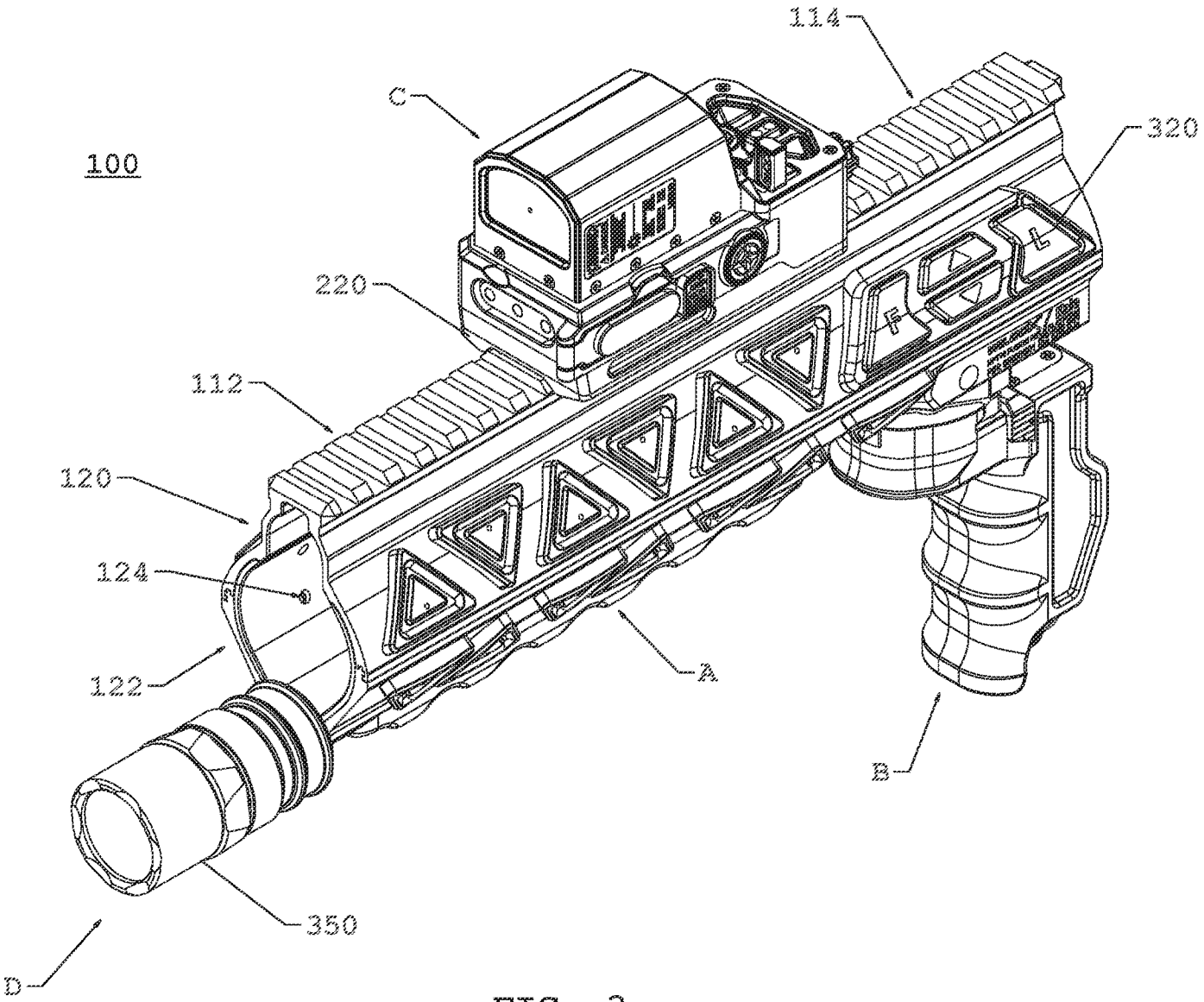
FIG. 3 is an isometric view of the powered accessory system appearing in FIG. 1, with the firearm and legacy accessory devices removed.
Figure 4:
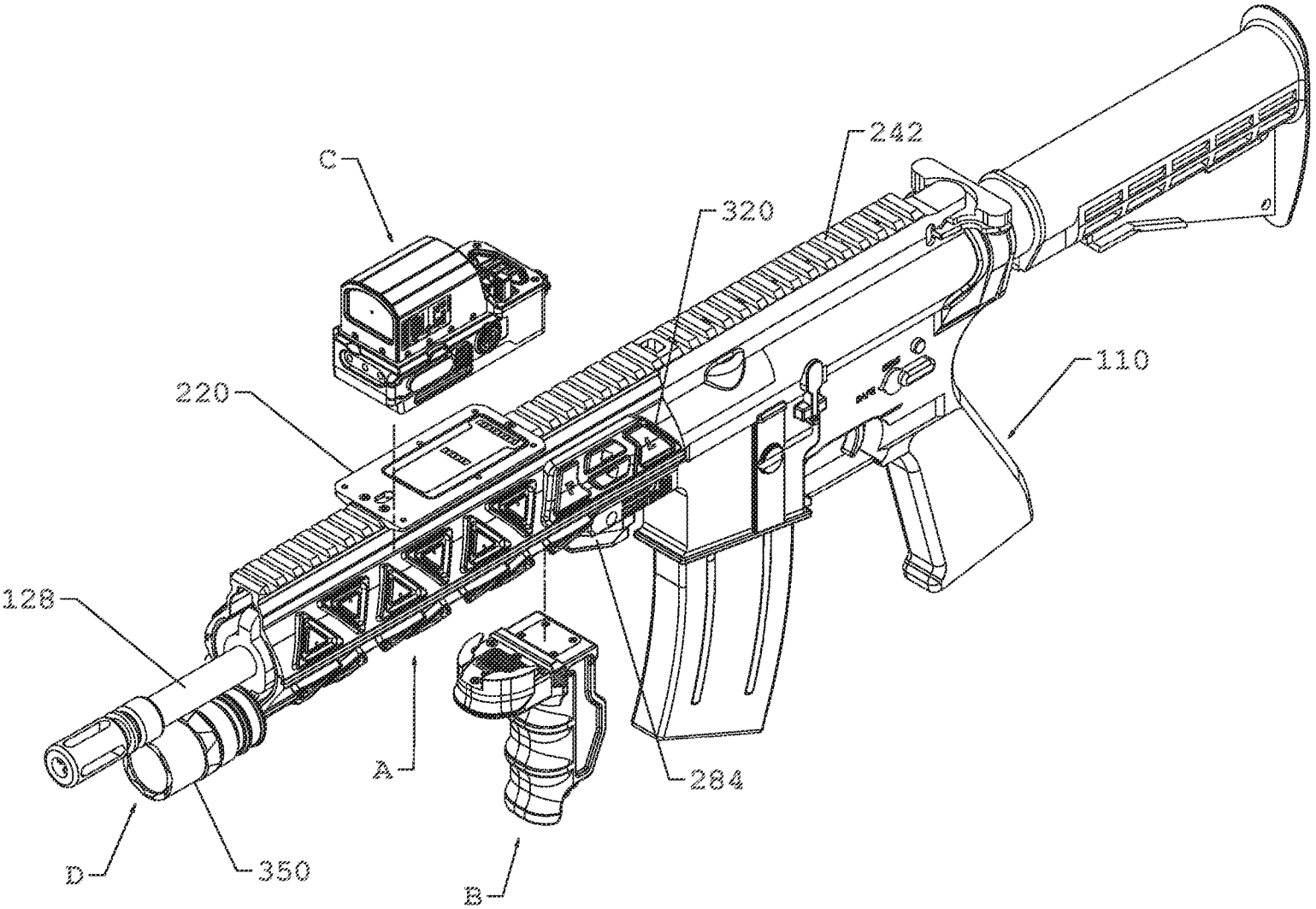
FIG. 4 is a partially exploded view of the powered weapon accessory platform appearing in FIG. 1.
Figure 5:
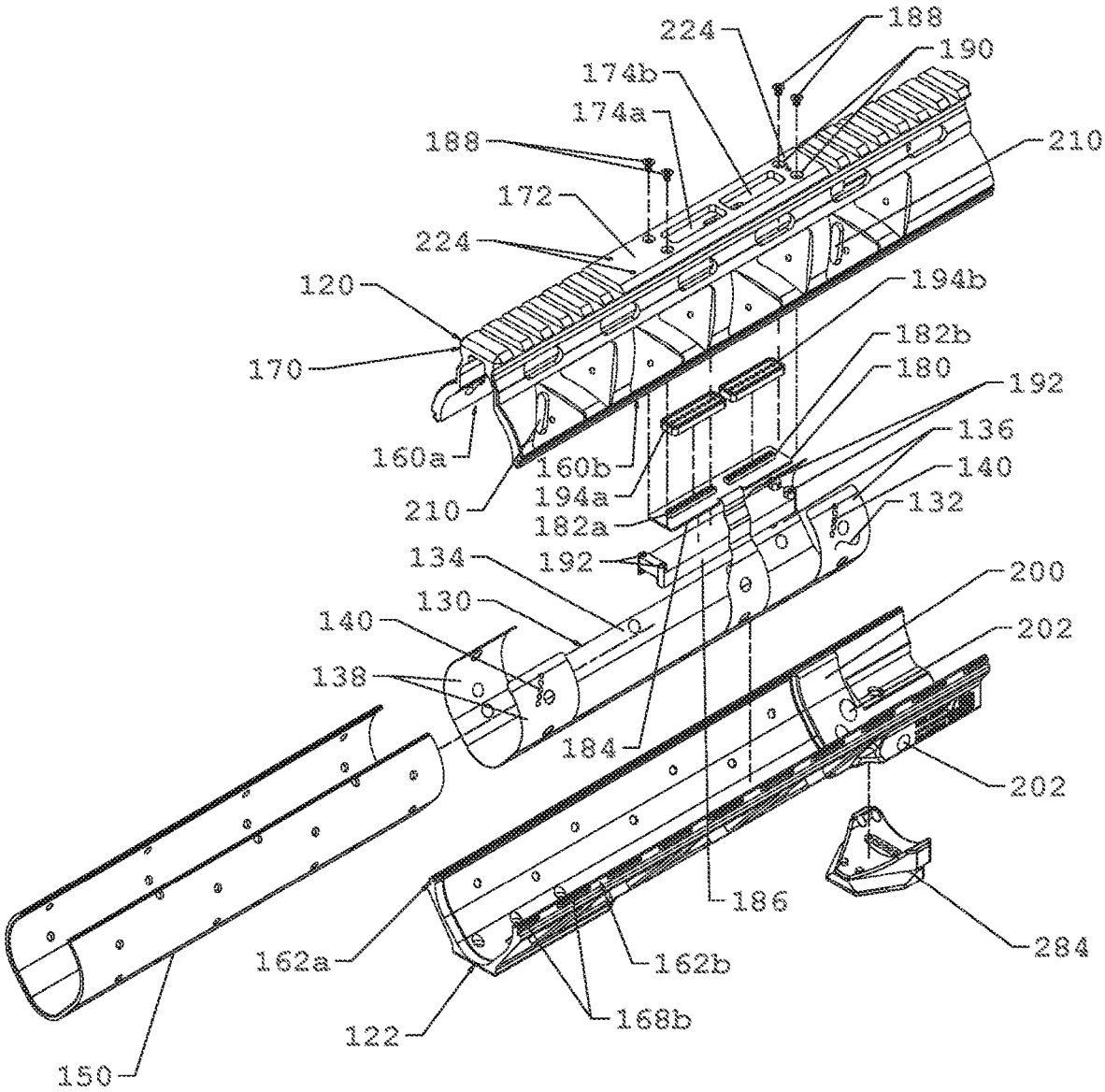
FIG. 5 is an exploded isometric view of the hand guard assembly appearing in FIG. 1.
Figure 6B:
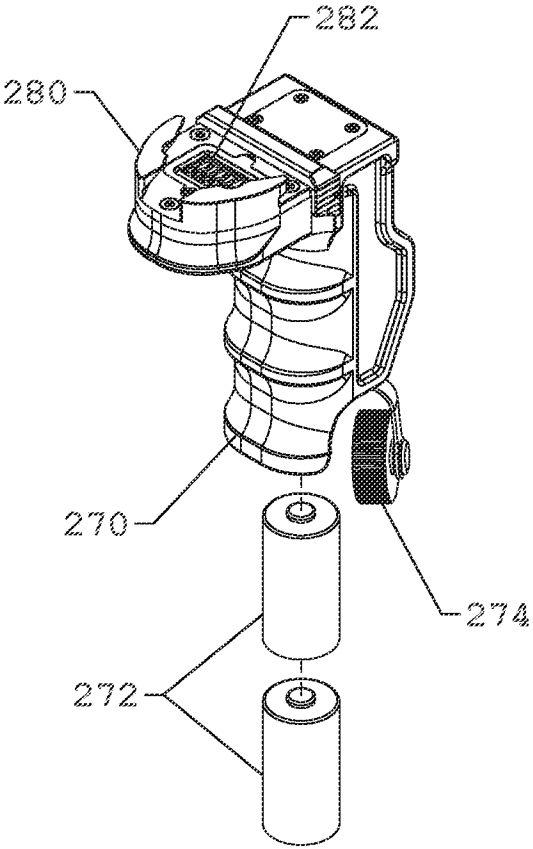
FIG. 6B is an enlarged view of the handgrip illustrating the manner of inserting and removing batteries.
Figure 6A:
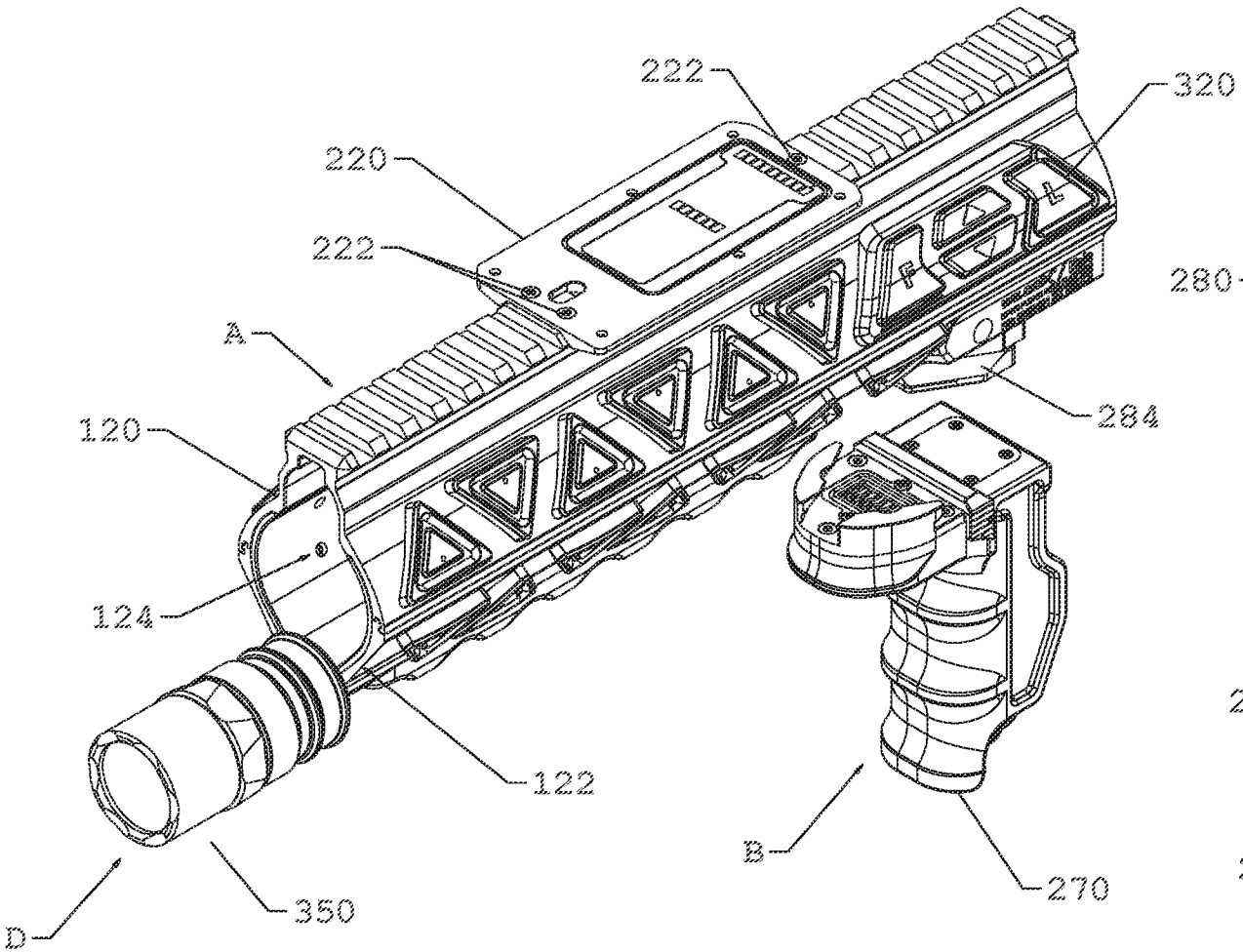
FIG. 6A is a partially exploded view illustrating the manner of attaching the handgrip.
Figure 7:
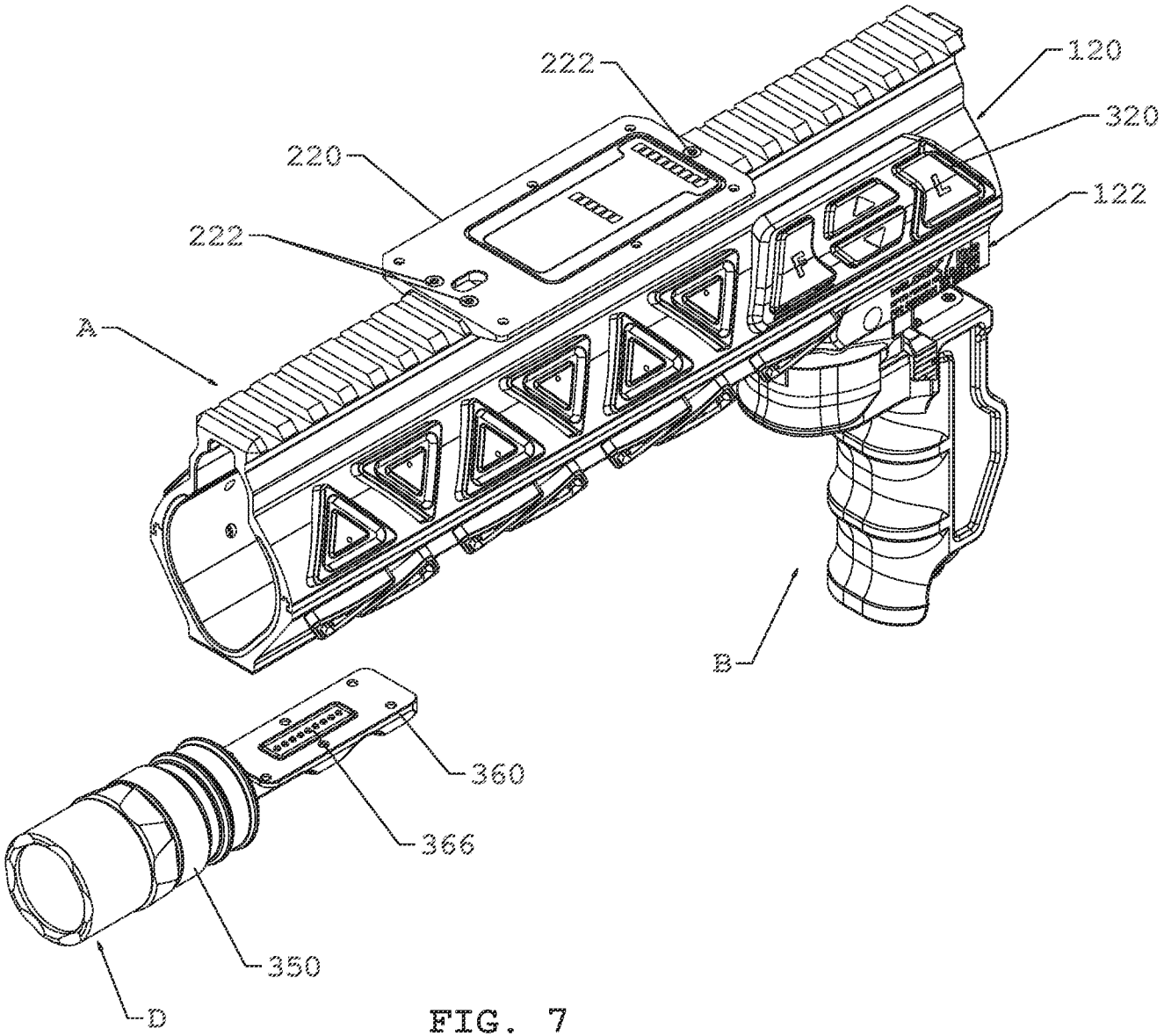
FIG. 7 is a partially exploded view illustrating the manner of attaching the flashlight.
Figure 8:
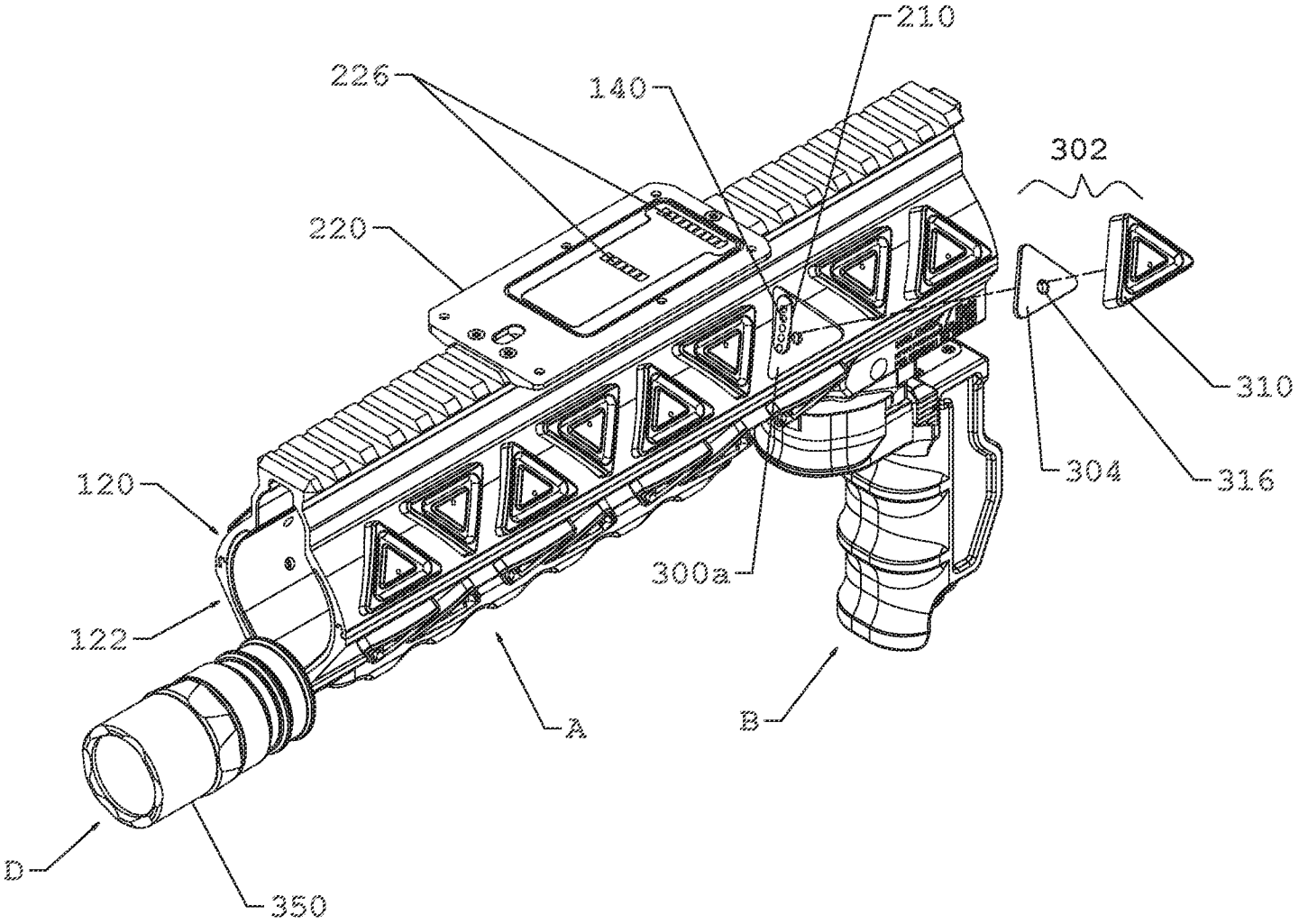
FIGS. 8 and 9 are partially exploded views illustrating the construction of the removably hand guard pads.
Figure 9:
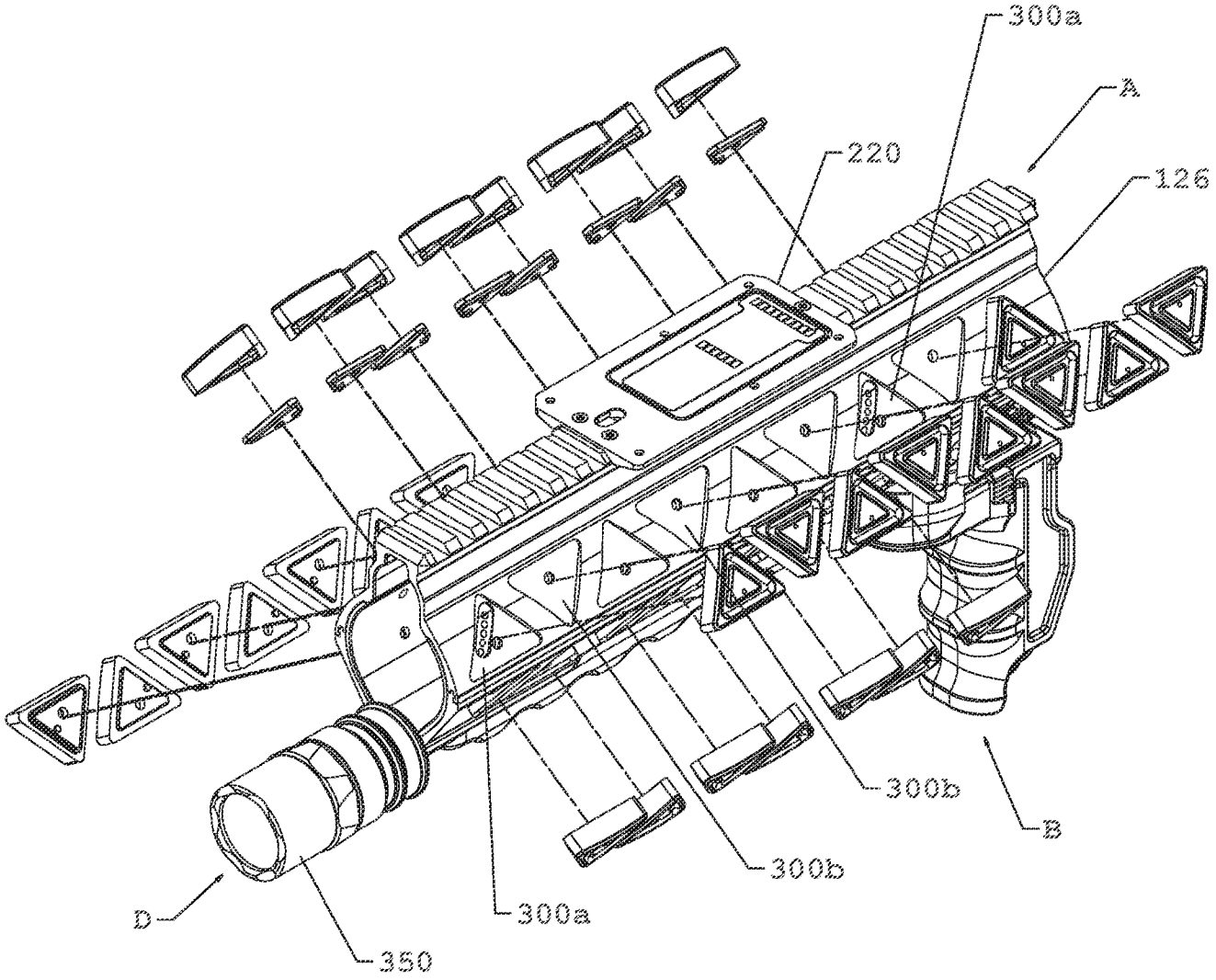
Figure 10:
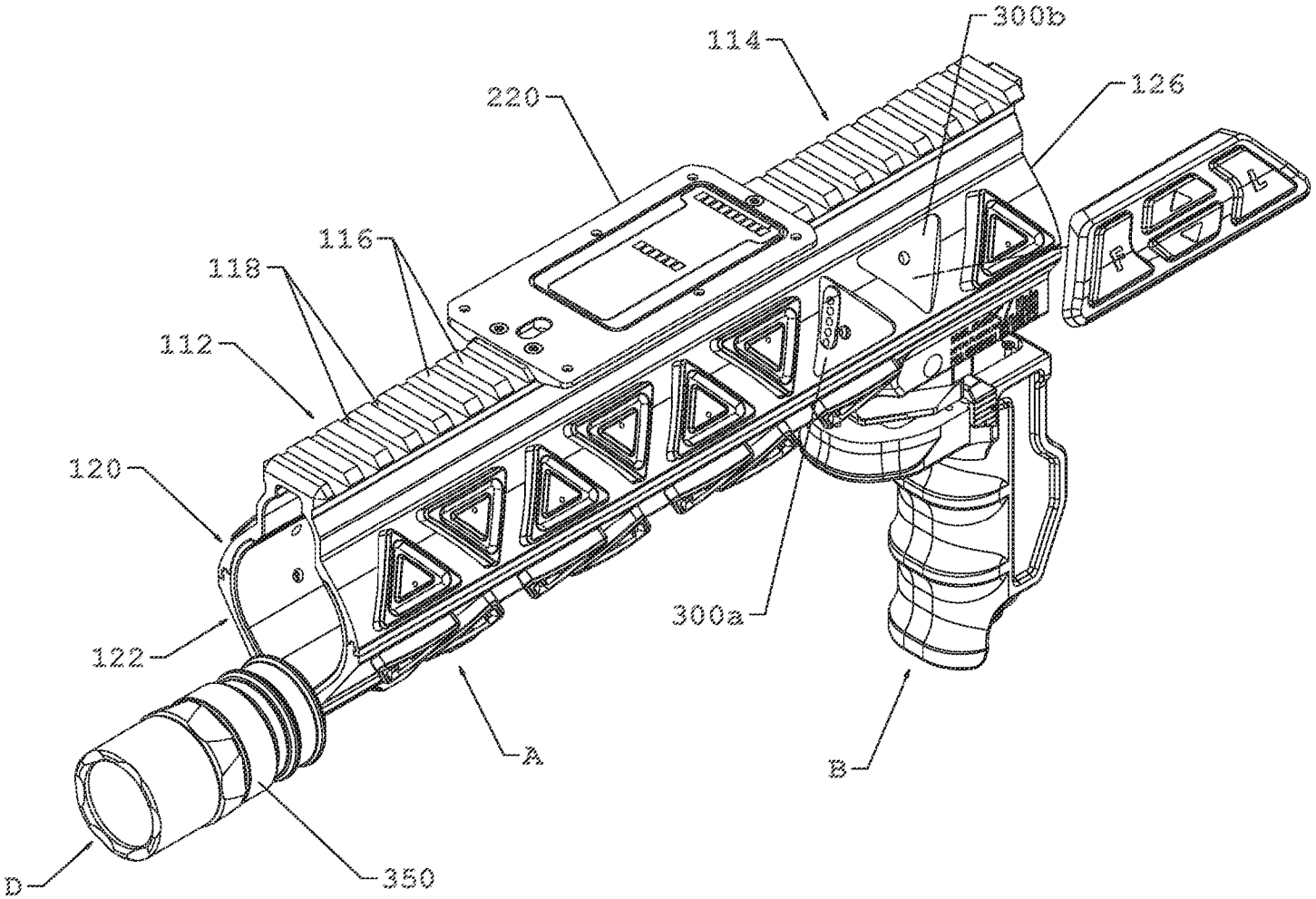
FIGS. 10 and 11 are partially exploded views illustrating the manner of attaching and removing the keypad.

Referring now to the drawing FIGS. 1-5, 6A, 6B, 7-13, 14A, 14B, and 15-20, wherein like reference numbers refer to like components throughout the several views, an exemplary powered weapon accessory platform 100 includes a hand guard assembly A, a vertical handgrip B, a first electrically operated accessory device C, and a second electrically operated device D. The hand guard assembly A is configured to attach to a firearm 110 or other weapon. In certain embodiments, the present system is configured to attach to a military or tactical weapon, such as an AR-15, M4 Carbine, M-16, other like firearms, in place of a conventional accessory rail system, such as a Picatinny rail system (MIL-STD-1913 or NATO equivalent STANAG 4694) that extends around the barrel of the weapon. It will be recognized, however, that the hand guard assembly A may include one or more accessory rail sections 112, 114 of conventional configuration to allow legacy accessory devices to be mounted to the weapon 110. In the illustrated embodiment, each of the rail sections 112, 114 have generally T-cross sectional shaped rail members 116 having recoil grooves 118 therebetween, as is known in the art.

The hand guard assembly A includes an upper shell 120 and a lower shell 122 which cooperate to define an axially extending sleeve 124 defining a channel which is attached to the firearm 110 at or near a first, proximal end 126 and extends distally to surround at least a portion of a barrel 128 of the firearm 110. The upper and lower shells 120, 122 may be formed of a metal (including metal alloys) and may be formed by casting, extrusion, molding, machining, additive manufacturing, or any combination thereof.

A flex circuit 130 includes a flexible circuit substrate 132 formed of a material such as a polyimide or other suitable flexible film material having printed circuit elements formed thereon. The flex circuit 130 includes an axially extending portion 134, a first pair of transversely extending arms 136 at or near the proximal end of the hand guard assembly A and partially surrounding the barrel 128 and a second pair of transversely extending arms 138 located at or near the distal end of the hand guard assembly A and partially surrounding the barrel 128. Each of the arms 136, 138 has a plurality of contact pads 140 formed thereon.

A heat shield 150 is disposed between the barrel 128 and the flex circuit 130 to protect the flex circuit 130 and the user's hands from heat buildup in the barrel 128. The flex circuit 130 is sandwiched between the heat shield 150 and the sleeve 124. Fasteners passing through aligned openings in the flex circuit substrate and the heat shield 150 may be employed to secure the flex circuit within the sleeve 124. The heat shield 150 extends in the axial direction and partially surrounds the barrel 128. The heat shield 150 may be formed of aluminum or other thermally conductive material.

The upper shell 120 includes a pair of opposing axially extending edges 160*a*, 160*b*, which engage complementary axially extending edges 162*a*, 162*b*, respectively, on the lower shell 122. In preferred embodiments, the edges of one pair have a retaining groove which receives a complementary tongue on the edges of the other pair. In the illustrated embodiment, the axially extending edges 160*a*, 160*b*, each have axially extending grooves 164*a*, 164*b*, which have a generally T-shaped cross-sectional shape. The axially extending edges 162*a*, 162*b*, each have an axially extending tongue members including vertically extending tongue members 166*a*, 166*b*, which extend continuously along the axial length of the lower shell 122, and horizontally extending tongue members 168*a*, 168*b*, which are segmented along the axial length of the bottom shell 122.

The upper facing surface 170 of the upper shell 120 includes a mounting region 172 intermediate the front rail section 112 and the rear rail section 114. The mounting region 172 includes a generally flat surface having first and second apertures 174*a*, 174*b* for receiving electrical connector elements 182*a*, 182*b* therethrough. The connector elements 182*a*, 182*b* include a plurality of contacts electrically coupled to the circuit elements on the flex circuit 130.

The flex circuit 130 includes a connector portion 180 having the connector elements 182*a*, 182*b* mounted thereon. A backer or stiffener board 184 formed of a rigid material is disposed beneath the portion 180 to reinforce the flex circuit at the connector portion 180. The connector portion 180 with stiffener board 184 is disposed on a mounting plate 186 which is secured within the interior of the upper shell 120 in alignment with the mounting region 172 via a plurality of fasteners such as threaded fasteners 188 which pass through openings 190 in the upper surface and engage complementary openings 192 in the mounting plate. Rubber or other polymeric (e.g., elastomeric) seals 194*a*, 194*b* may be disposed in the apertures 174*a*, 174*b* between the upper surface 170 and the connector elements 182*a*, 182*b*, e.g., to seal around the connector elements to protect against water or moisture entering into the interior of the sleeve 124 via the apertures 174*a*, 174*b*.

The lower shell 122 includes a reinforced portion 200 at or near the proximal end of the lower shell and includes one or more openings 202 for receiving one or more fasteners for securing the hand guard assembly A to the weapon. In certain embodiments, the hand guard assembly A is attached to the weapon at its proximal end and extends distally. In certain embodiments, the hand guard assembly A is configured to attach to a receiver portion, e.g., upper receiver in the case of a two piece type of receiver, of a firearm. In preferred embodiments, the hand guard assembly A is attached to the firearm via a barrel nut which attaches the firearm barrel to the receiver.

The contact pads 140 define a plurality of contacts electrically coupled to the circuit elements on the flex circuit 130 and are aligned with corresponding apertures 210 in the upper shell 120.

The electrically operated device assembly C includes or is attached to an adapter or accessory mounting pad 220 configured to attached to the mounting region 172, e.g., via fasteners 222 passing through openings in the pad 220 and removably engaging aligned openings 224 in the mounting region 172. The platform 220 includes electrical connector elements (not shown) on a bottom surface of the accessory mounting pad which are aligned with the connector elements 182*a*, 182*b*. A circuit board is housed within the pad 220 to provide electrical communication between the connector elements 182*a*, 182*b* and contact elements 226 on the upper surface of the pad 220.

The electrically operated device C, in turn, is attached to the pad 220, e.g., via fasteners 232 passing through openings 234 in the pad 220 and engaging aligned openings in the device C housing. The illustrated pad 220 and device C are exemplary only. Electrical contacts 230 on the device C engage the contacts 226 on the pad 220.

In certain embodiments, a plurality of interchangeable pads may be provided to accommodate different devices C. In preferred embodiments, the electrically operated device is a sighting device, such as a reflex sight and/or laser sight. In preferred embodiments, the device C may be a combined laser/reflex sight, such as that described in commonly owned U.S. provisional application No. 62/063,210 filed Oct. 13, 2014, and U.S. nonprovisional application Ser. No. 14/881,779 filed Oct. 13, 2015, each of which is incorporated herein by reference in its entirety. The device C may be used in combination with other accessory devices. For example, in the exemplary embodiment appearing in FIG. 1, the reflex sight of the device C may be used in combination with an optical magnifier 240 positioned behind the device C and a thermal camera device 250 positioned in front of the device C. The thermal camera 250 is secured to the front rail section 112 via a pivoting rail clamp 260, which allows the thermal camera 250 to be pivoted out of the line of sight of the user when not in use. The scope/magnifier 240 is secured to a rail section 242 on the upper receiver portion of the firearm via a second pivoting rail clamp 260, which allows the magnifier 240 to be pivoted out of the line of sight of the user when not in use.

The vertical handgrip B includes a housing 270 which defines a battery compartment receiving one or more batteries or battery packs 272, which is accessible via a battery compartment cover 274. The upper end of the handgrip B includes a hot shoe receptacle 280, such as a dovetail type hot shoe, having a plurality of electrical contacts 282 thereon. The contacts 282 engage aligned contacts 286 on a hot shoe 284 on the lower shell 122. The hot shoe 284 is attached to a lower surface 294 of the lower shell 122, e.g., via threaded fasteners, and the hot shoe electrical contacts are electrically coupled to the circuit carried on the flex circuit board 130. In certain embodiments, the electrical contacts on the hot shoe are electrically coupled to pick up points on the flex circuit via a wired connection, e.g., via soldering. The electrical contacts 282 on the hot shoe receptacle 280 and the electrical contacts 286 on the hot shoe 284 thus provide an electrical communication between the power supply 272 and the flex circuit 130.

The upper shell 120 includes two side surfaces 290 on opposite sides of the upper surface 170. The lower shell 122 includes two side surfaces 292 on opposite sides of a lower surface 294. Each of the side surfaces includes a plurality of recesses 300*a*, 300*b* axially spaced along its length. Each recess 300*a*, 300*b* is configured to receive a removable pad 302 which is configured to improve a user's grip and insulate the user's hand from heat generated in the barrel 128. Each of the pads 302 includes a rigid stiffener 304 which may be formed of a high temperature composite material and a cover 310 which may be formed of a flexible, heat-resistant material. In preferred embodiments, the cover 310 is formed of a silicone rubber (polysiloxane) material, having low thermal conductivity and high thermal stability. Preferably, the pads 302 are sized to protrude from the recesses 300*a*, 300*b* such that the protruding pads and soft cover materials provide improved traction between the user's hand and the fore end portion of the weapon.

Each of the stiffeners 304 is sized to be removably snap fit or press fit into a corresponding opening 314 in a recess 300*a*, 300*b*. Each of the stiffeners 304 also includes a protruding boss 316 on an outward facing surface which is sized to engage a complementary opening (not shown) on the inward facing surface of the cover 310. In the illustrated embodiment, the pads 302 are triangular in shape with every other pad 302 being inverted, although it will be recognized that other shapes are contemplated.

Figure 17:
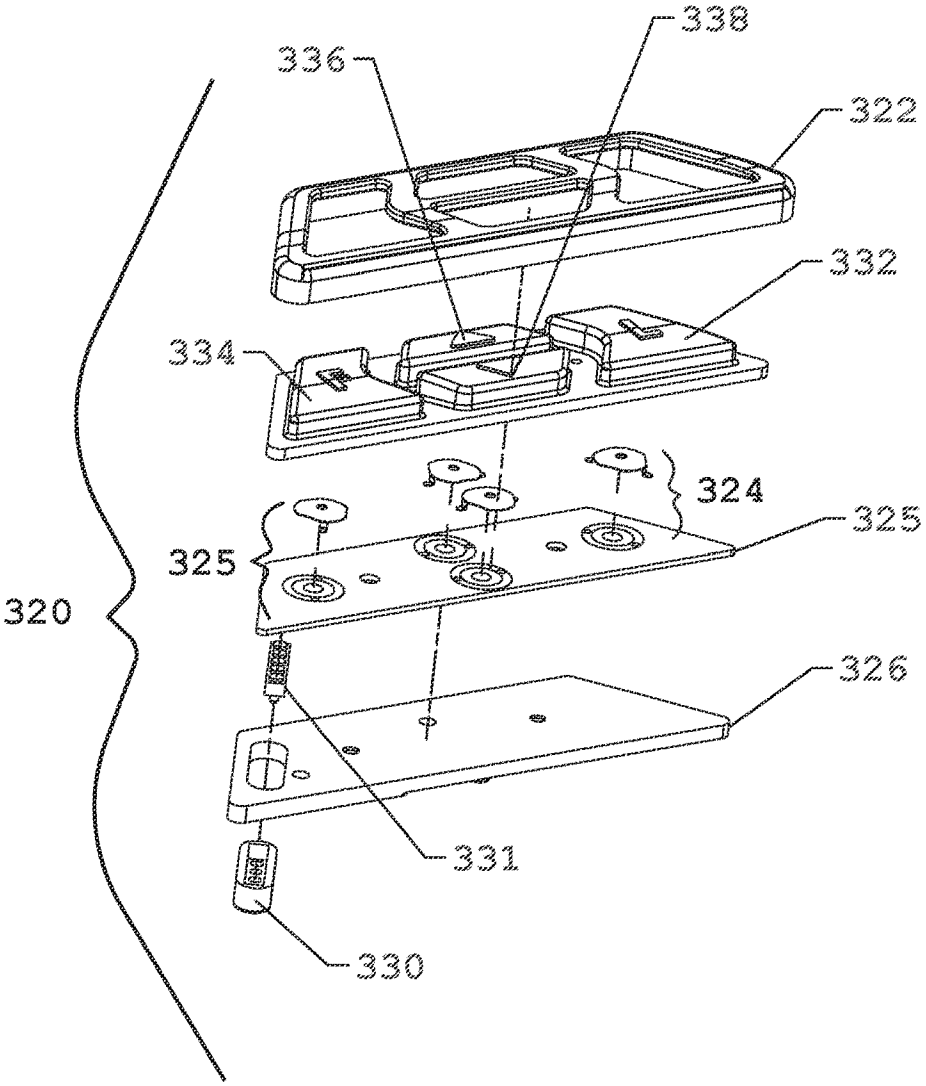
FIG. 17 is an enlarged, exploded view of an exemplary keypad.
Figure 19:
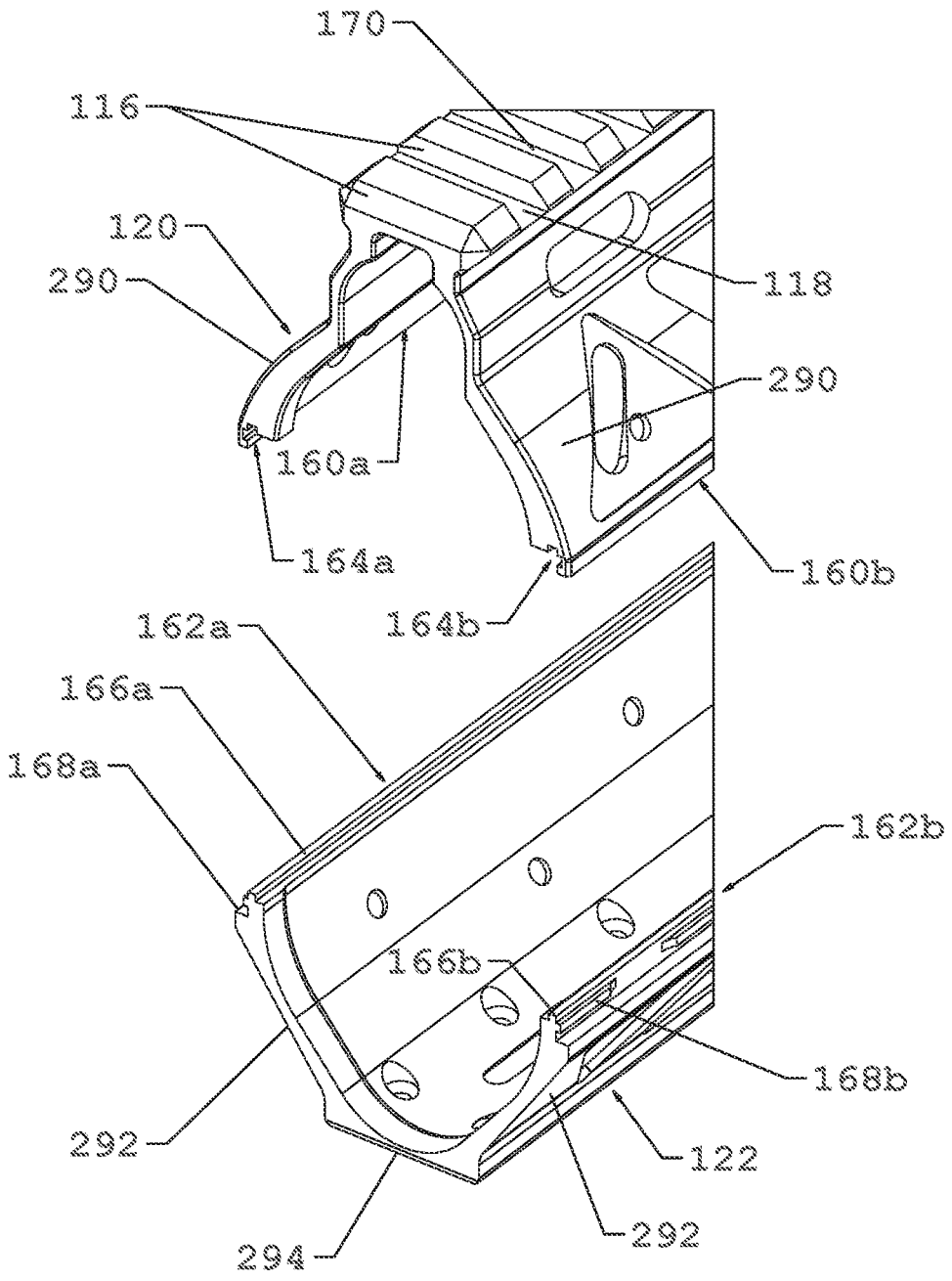
FIG. 19 is an enlarged, fragmentary, exploded view of the hand guard sleeve illustrating the manner of connecting the upper and lower shells.
Figure 20:
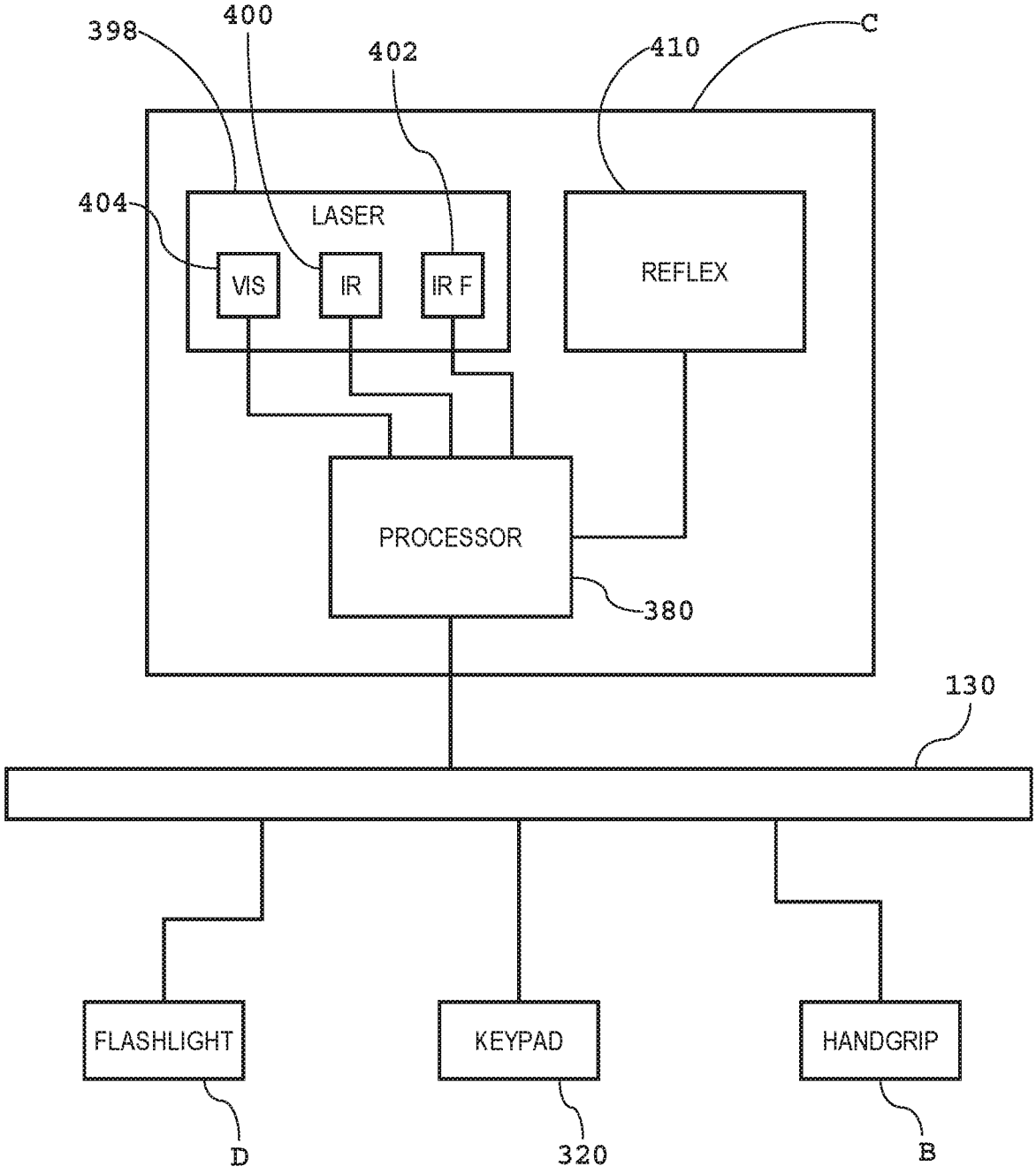
FIG. 20 is a block diagram illustrating the electrical operation of the powered accessory system embodiment herein.

Four of the recesses in the upper shell 120, designated 300*a*, include the apertures 210 to provide access to the contact pads 140 on the flex circuit 130. A keypad 320 includes front cover 322 having a plurality of depressible buttons (designated 332, 334, 336, 338) extending therethrough. A rear cover 326 includes a first triangular fastener 328*a* which is sized to be removably received within a desired one of the recesses 300*a*. A second triangular fastener 328*b* is configured to be received in an adjacent recess 300*b*. As shown in FIG. 17, each of the buttons 332, 334, 336, 338 includes a dome switch 324 on a circuit board 325 having a circuit matrix or grid. An electrical connector 330 includes a plurality of contacts 331 which engage the contacts 140 to electrically communicate a signal to the flex circuit 130 representative of which button 322 was pressed by the user.

Figure 11:
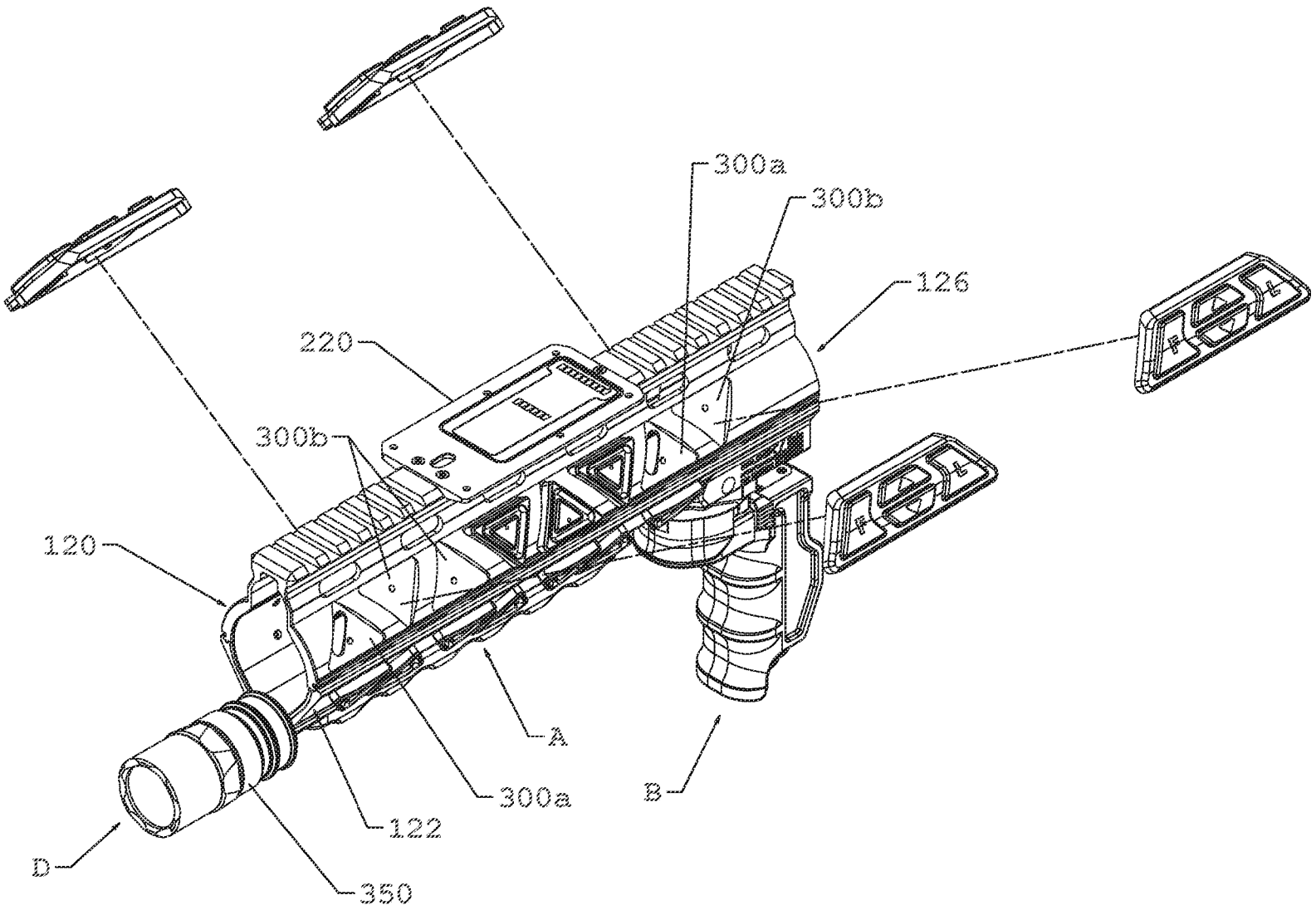
Figure 12:
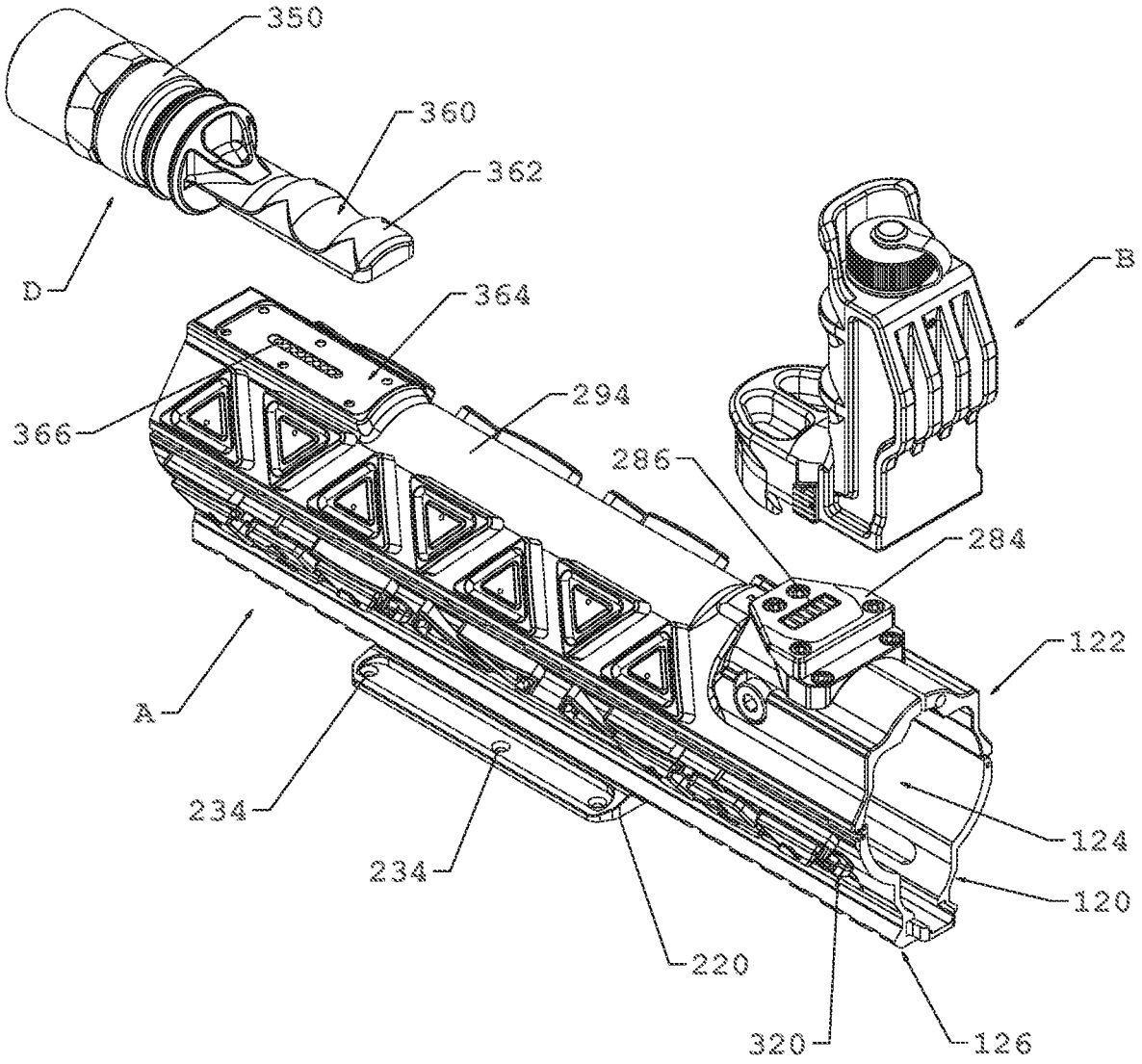
FIG. 12 is an exploded isometric view of the hand guard, handgrip, and flashlight, taken generally from the bottom.

The keypad 320 can be operatively connected to the flex circuit by attaching the key pad 320 at one of four designated positions on the upper shell 120, namely front left, front right, rear left, and rear right. As best seen in FIG. 11, when the key pad 320 is employed at one of the rearward positions, the corresponding pad 302 and one adjacent pad 302 must be removed. When the key pad 320 is employed at one of the front positions, the corresponding pad 302 and two adjacent pads 302 must be removed. Once the appropriate pads 302 are removed, the fasteners 328*a*, 328*b* are snap fit into the corresponding receptacle 300*a*, 300*b*.

In the illustrated embodiment, the key pad 320 includes a first actuator button 332 (designated "L" in the illustrated embodiment) for actuating the first electrically operated device and a second actuator button 334 (designated "F" in the illustrated embodiment) for actuating the second electrically operated device, and an increment up button 336 and an increment down button 338.

In the depicted embodiment, the second electrically operated device D is a flashlight comprising a flashlight head 350 extending distally from a mounting arm 360. The flashlight head 350 may have one or more light emitting elements, preferably LEDs. In certain embodiments, the flashlight head 350 includes one or more LEDs which emit radiation in a visible portion of the electromagnetic spectrum. In other embodiments, the flashlight head 350 includes one or more LEDs which emit radiation in an infrared portion of the electromagnetic spectrum. In still further embodiments, the flashlight head 350 is a dual mode flashlight which includes one or more LEDs which emit radiation in a visible portion of the electromagnetic spectrum and one or more LEDs which emit radiation in an infrared portion of the electromagnetic spectrum.

The mounting arm 360 includes a housing 362 which is configured for mounting to a complementary mounting pad 364 on distal end of the lower surface 294 of the shell 122. The mounting arm also includes an electrical connector 366 which mates with a complementary electrical connector 368 on the flashlight mounting pad 364.

The key pad 320 is operative to remotely control operation of both the first device C and the second device D. The flex circuit 130 operates as a power bus wherein both the first and second devices C, D are operable to receive power through the bus responsive to a processor 380 (see FIG. 20) such as a microprocessor or microcontroller within the first device driving the bus. The first device C includes a selector knob 382 which functions as an input device to the processor 380. The knob 382 includes an indicator or mark 384 which is rotatable to select a desired function represented by indicia 390*a*-390*h*.

The selector knob 382 is used to select the source(s) that are operated by the keypad buttons. Indicium 390*a* ("Off") corresponds to the off position wherein the device C is powered down and no light sources will be activated by the actuator button 332. Indicium 390*b* ("Ir A") corresponds to the IR aiming or pointing laser 400 of a laser module 398, which is actuated by the button 332 in this configuration. Indicium 390*c* ("Ir F") corresponds to the IR flood laser 402, which is actuated by the button 332 in this configuration. Indicium 390*d* ("Ir D") corresponds to the dual IR mode wherein both the IR aiming laser 400 and the IR flood laser 402 are operated simultaneously by the button 332. Indicium 390*e* ("Rfx") corresponds to the reflex sight 410 and its corresponding light source is actuated by the button 332 in this configuration. Indicium 390*f* ("Vis") corresponds to the visible wavelength aiming or pointing laser 404, which is operated by the button 322 in this configuration. Indicium 390*g* ("FL") corresponds to the flashlight 350 which is operated by the button 334 in this configuration. Indicium 390*h* ("Vis FL") corresponds to a dual mode wherein the visible aiming laser 404 and the flashlight 350 are operated simultaneously by the buttons 332 and/or 334. The intensity increment button 336 and intensity decrement button 338 are provided to increase and decrease, respectively, the intensity output of whichever light source(s) are selected by the selector knob 382.

Figure 13:
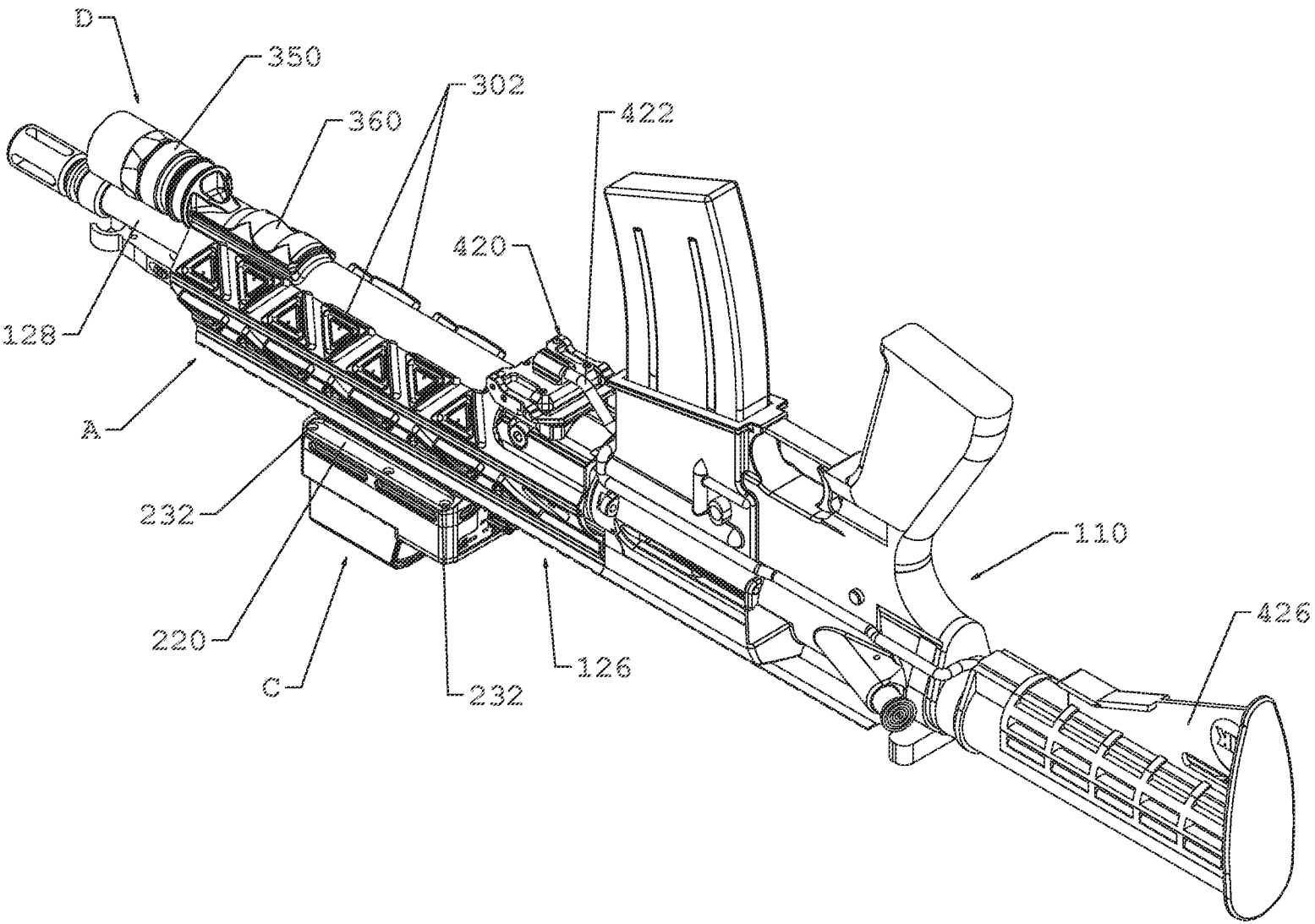
FIG. 13 is an isometric view of a further exemplary embodiment of a powered accessory system, taken generally from the bottom, illustrating an alternative connector for remote power supply located in the weapon buttstock.
Figures 14A, 14B:
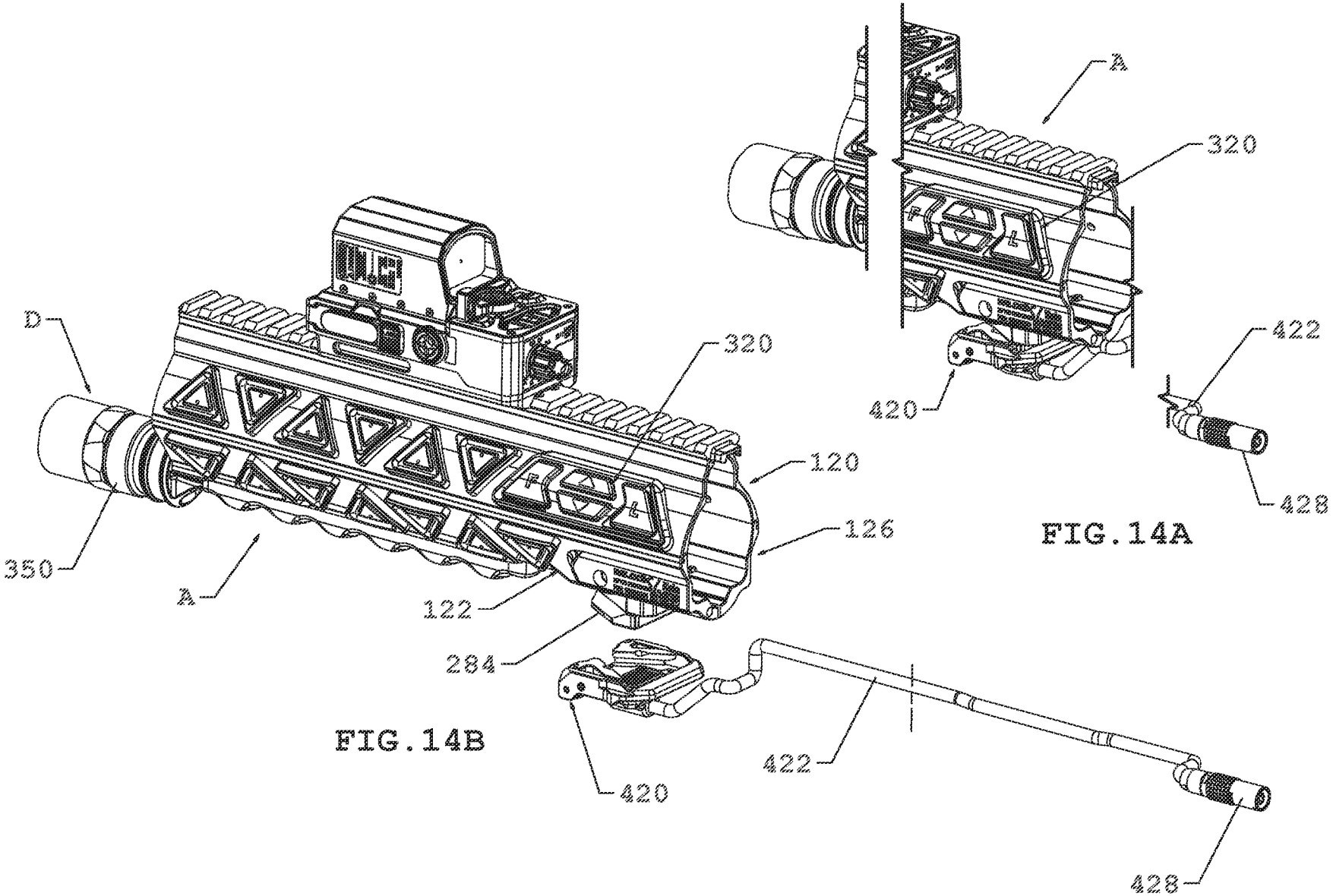
FIGS. 14A and 14B are fragmentary and partially exploded isometric views, respectively, illustrating an alternative connector for remote power supply which replaces the handgrip power supply.
Figure 16:
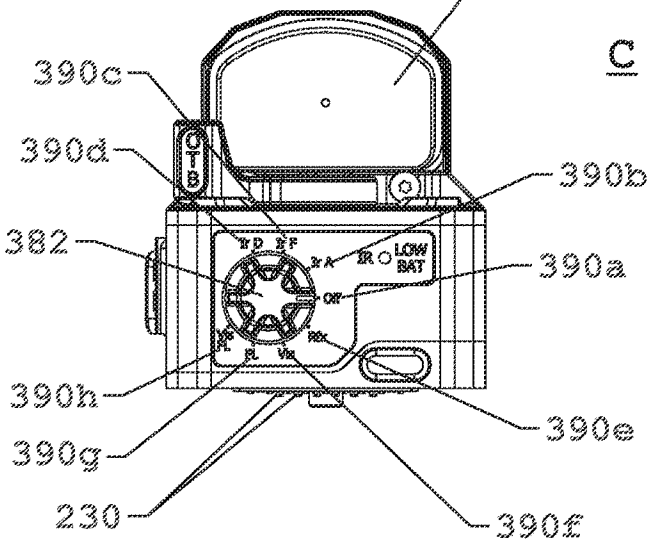
FIGS. 15 and 16 are isometric and rear elevational views, respectively, of exemplary first electrically operated accessory device.
Figure 15:
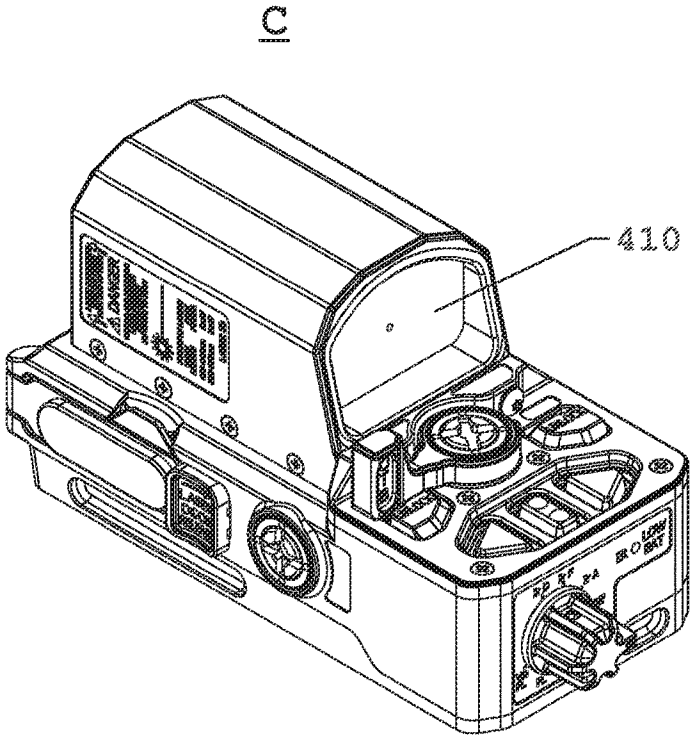
Figure 18:
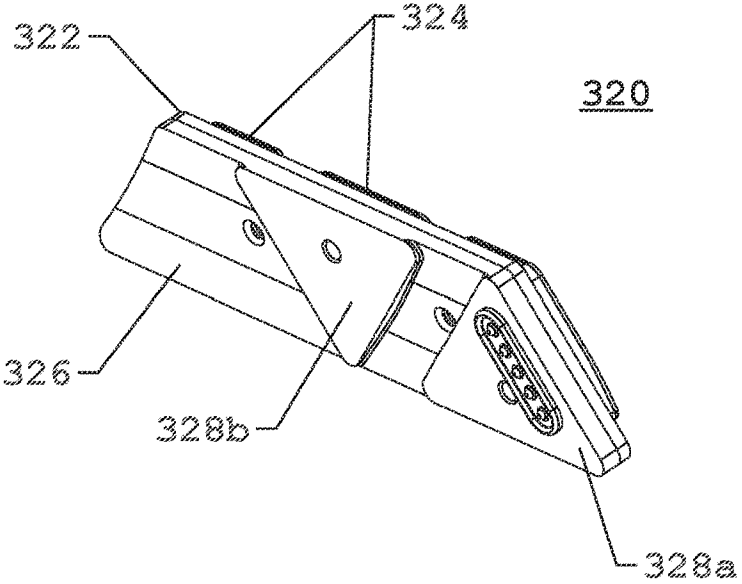
FIG. 18 is an enlarged, isometric view of the keypad appearing in FIG. 17, taken generally from the bottom.

In certain embodiments, the user may not wish to use the vertical grip B. In such cases, the hot shoe 284 may be coupled to an alternative remotely located power supply. For example, as shown in FIGS. 13, 14A, and 14B, the handgrip B may be replaced with an electrical connector 420 which is configured to receive the hot shoe 284. A cable 422 is provided to electrically couple the hot shoe 284 to a remote power supply, which is preferably a remote power supply located elsewhere on the weapon. It will be recognized, however, that alternative remote power supplies are also contemplated, such as a power supply configured to be worn by the user.

In certain embodiments, as shown in FIG. 13, a remote power supply 424 is housed within the buttstock 426 of the weapon. In alternative embodiments, as shown in FIGS. 14A and 14B, the cable 422 may terminate in an electrical connector 428 for a removable electrical connection to a remote power supply.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A powered accessory platform for a weapon, comprising:

a handguard assembly including an upper handguard portion and an opposed lower handguard portion, the upper handguard portion and the lower handguard portion cooperating to define a sleeve, the sleeve having a proximal end configured to attach to the weapon and a distal end opposite the proximal end, the sleeve configured to surround at least a portion of the weapon when the proximal end is attached to the weapon;

a flexible circuit within the sleeve, the flexible circuit comprising one or more circuit elements disposed on a flexible circuit substrate;

first and second accessory mounting rails located on a top portion of the upper handguard portion and a generally flat section disposed intermediate the first and second accessory mounting rails, the generally flat section having at least one electrical connector thereon, wherein said at least one electrical connector comprises a connector element extending though an opening in the top portion and a seal member disposed within the opening to provide a sealing engagement between the connector element and the top portion to prevent water from entering the sleeve;

a first accessory mounting pad mechanically and electrically coupled to the generally flat section, wherein the first accessory mounting pad includes one or more mechanical fasteners for removably securing an electrically operated device to the first accessory mounting pad and wherein the first accessory mounting pad includes electrical contacts for electrically coupling the electrically operated device to the at least one electrical connector on the generally flat section; and a power supply connector on the sleeve configured to attach to a power supply.

2. The powered accessory platform of claim 1, further comprising a heat shield received within the sleeve, wherein the flexible circuit is disposed between the heat shield and the sleeve.

3. The powered accessory platform of claim 1, wherein the first accessory mounting pad is removable from the generally flat section.

4. The powered accessory platform of claim 1, wherein the first accessory mounting pad is interchangeable with one or more alternative accessory mounting pads.

5. The powered accessory platform of claim 1, wherein the power supply connector is disposed on the lower handguard portion.

6. The powered accessory platform of claim 1, wherein each of the first and second accessory mounting rails are selected from a MIL-STD-1913 rail and a STANAG 4694 rail.

7. The powered accessory platform of claim 1, wherein the flexible circuit includes an axially extending portion, a first pair of transversely extending arms adjacent the proximal end of the sleeve and a second pair of transversely extending arms adjacent the distal end of the sleeve, wherein at least one of the arms of the first pair of arms has a first plurality of contact pads formed thereon and at least one of the arms of the second pair of arms has a second plurality of contact pads formed thereon, the first and second plurality of contact pads defining a plurality of contacts electrically coupled to the one or more circuit elements on the flexible circuit.

8. The powered accessory platform of claim 1, wherein the upper handguard portion has a first edge and the lower handguard portion has a second edge, the first and second edges having a complementary cross-sectional shape.

9. The powered accessory platform of claim 8, wherein one of the first edge and the second edge has a retaining groove which receives a complementary tongue of the other of the first edge and the second edge.

10. The powered accessory platform of claim 1, wherein said at least one electrical connector is attached to a circuit board and electrically coupled to said one or more circuit elements disposed on the flexible circuit substrate.

11. The powered accessory platform of claim 1, wherein said at least one electrical connector extends through a corresponding aligned opening in the generally flat section.

12. The powered accessory platform of claim 11, wherein the first accessory mounting pad is attached to the generally flat section use one or more threaded fasteners passing through openings in the first accessory mounting pad and removably engaging aligned openings in the generally flat section.

13. The powered accessory platform of claim 12, wherein the first accessory mounting pad includes a circuit board electrically coupling a first set of electrical connector elements on an upper surface of the first accessory mounting pad and a second set of connector elements on a lower surface of the first accessory mounting pad.

14. The powered accessory platform of claim 12, wherein the electrically operated device is selected from the group consisting of a reflex sight, a laser sight, and a combined laser/reflex sight.

15. The powered accessory platform of claim 1, wherein the lower handguard portion includes a reinforced section having one or more openings for receiving one or more fasteners for securing the handguard assembly to the weapon.

16. The powered accessory platform of claim 15, wherein the one or more fasteners for securing the handguard assembly to the weapon are configured to engage a barrel nut of the weapon.

17. The powered accessory platform of claim 1, further comprising a handgrip removably connected to the power supply connector, the handgrip including a housing defining a battery compartment removably receiving the power supply, wherein the power supply includes one or more batteries or battery packs.

18. The powered accessory platform of claim 17, wherein the handguard assembly further comprises a lower shell and wherein the handgrip includes an upper end having a hot shoe receptacle, wherein the lower shell includes a hot shoe removably engaging the hot shoe receptacle, the hot shoe receptacle having a first plurality of electrical contacts aligned with a second plurality of electrical contacts on the hot shoe.

19. The powered accessory platform of claim 18, wherein the hot shoe is attached to a lower surface of the lower shell and the second plurality of electrical contacts are electrically coupled to the flexible circuit.

20. The powered accessory platform of claim 1, further comprising:

the upper handguard portion including first and second axially extending side surfaces on opposite transverse sides of the top portion;

the lower handguard portion including an axially extending bottom portion and third and fourth axially extending side surfaces on opposite transverse sides of the axially extending bottom portion;

each of the first, second, third and fourth side surfaces including a plurality of axially spaced recesses along a length of the handguard assembly, wherein each recess is configured to receive a removable pad configured to improve a user's grip and/or insulate the user's hand from heat generated in a barrel of the weapon during operation of the weapon.

21. The powered accessory platform of claim 20, wherein each of the pads includes:

a rigid stiffener formed of a temperature resistant material; and a cover received over the rigid stiffener, the cover formed of a flexible, heat-resistant material.

22. The powered accessory platform of claim 20, wherein each of the pads is formed of a silicone rubber material having low thermal conductivity and high thermal stability.

23. The powered accessory platform of claim 20, further comprising a keypad removably attached to one or both of the first and second side surfaces and in electrical communication with the flexible circuit, wherein the keypad is operatively connected to the flexible circuit, the keypad configured to control operation of the electrically operated device.

24. The powered accessory platform of claim 23, wherein the keypad is attachable at a plurality of locations on the first side surface and the second side surface.

25. The powered accessory platform of claim 1, further comprising a second accessory mounting pad disposed on a bottom surface of the lower handguard portion, the second accessory mounting pad including a plurality of connector elements electrically coupled to the flexible circuit.

26. The powered accessory platform of claim 25, further comprising a flashlight module including a flashlight head extending distally from a mounting arm, the mounting arm removably attachable to the second accessory mounting pad.

27. The powered accessory platform of claim 26, further comprising the power supply remotely located with respect to the flashlight module, the power supply connected to the power supply connector and electrically coupled to the flashlight module.

* * * * *